US005080532A

United States Patent [19]

Merville et al.

[11] Patent Number: 5,080,532

[45] Date of Patent: Jan. 14, 1992

[54] SELF-PROPELLED MACHINE FOR THE CONCRETING OF DITCHES

[75] Inventors: Pierre Merville; Jacques Merville, both of Arudy, France

[73] Assignee: En Treprise Merville Pierre, Arudy, France

[21] Appl. No.: 477,822

[22] PCT Filed: Aug. 23, 1989

[86] PCT No.: PCT/FR89/00427

§ 371 Date: Apr. 25, 1990

§ 102(e) Date: Apr. 25, 1990

[87] PCT Pub. No.: WO90/02227

PCT Pub. Date: Mar. 8, 1990

[30] Foreign Application Priority Data

Aug. 23, 1988 [FR] France ..... 88 11111

[51] Int. Cl.[5] ..... E02B 5/02; E01C 19/48

[52] U.S. Cl. ..... 405/268; 404/96

[58] Field of Search ..... 405/150, 155, 268; 404/96, 101, 102, 105, 106, 108

[56] References Cited

U.S. PATENT DOCUMENTS

| | | | |
|---|---|---|---|
| 3,566,760 | 3/1971 | Lalleur et al. . | |
| 4,319,859 | 3/1982 | Wise . | |
| 4,432,672 | 2/1984 | Bruderle et al. | 405/268 |

FOREIGN PATENT DOCUMENTS

| | | | |
|---|---|---|---|
| 0071074 | 2/1983 | European Pat. Off. . | |
| 2724470 | 12/1978 | Fed. Rep. of Germany . | |
| 3031688 | 4/1982 | Fed. Rep. of Germany . | |
| 2400084 | 3/1979 | France . | |
| 498390 | 5/1976 | U.S.S.R. | 405/268 |
| 1110370 | 4/1968 | United Kingdom . | |

*Primary Examiner*—David H. Corbin

*Attorney, Agent, or Firm*—Watson, Cole, Grindle & Watson

[57] ABSTRACT

A self-propelled machine for concreting a ditch includes a caterpillar band which contacts and rolls on the bottom of the ditch, a propulsion unit for driving the displacement belt, and a spreading system for spreading concrete on the bottom and sides of the ditch.

12 Claims, 3 Drawing Sheets

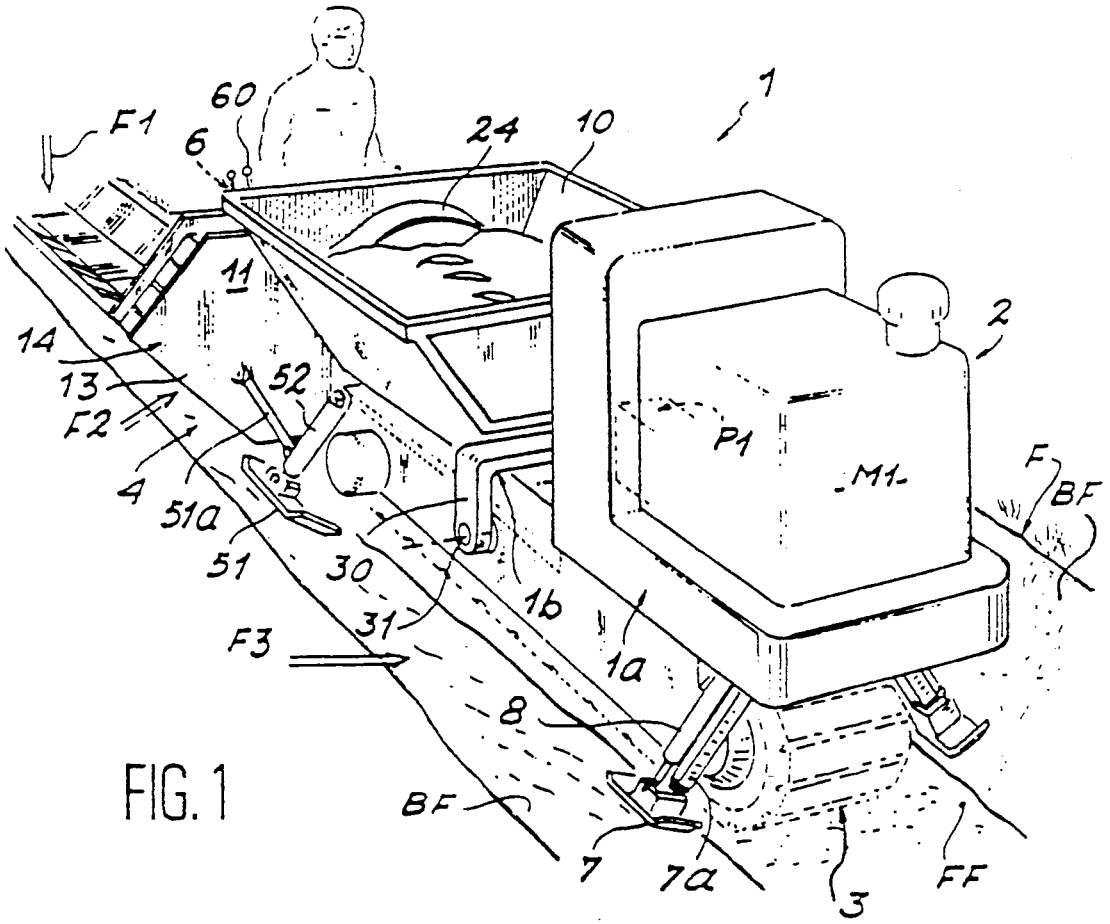
FIG. 1
FIG. 3
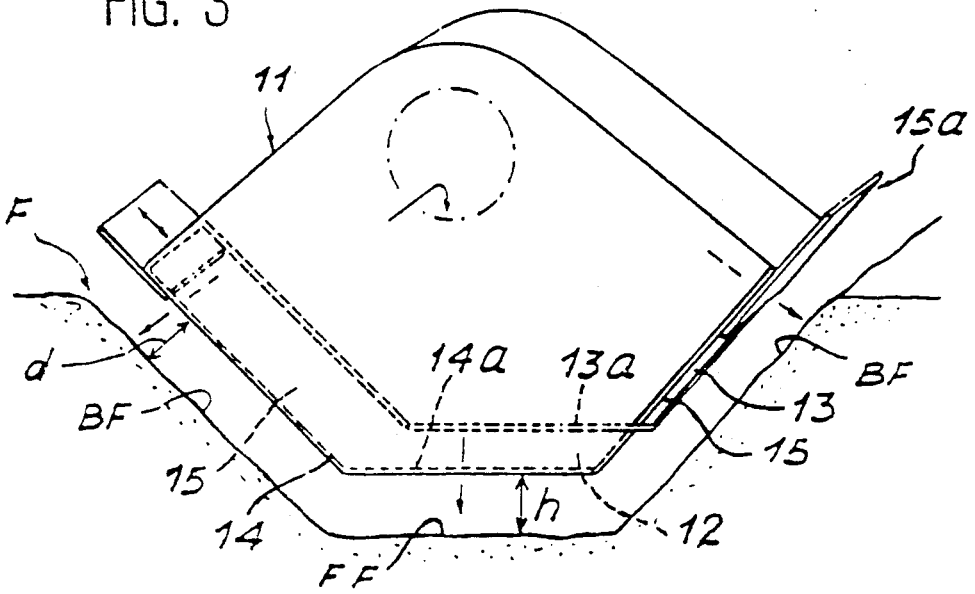

SELF-PROPELLED MACHINE FOR THE CONCRETING OF DITCHES

BACKGROUND OF THE INVENTION

The present invention relates to a self-propelled machine for the concreting of ditches, of the type comprising a propulsion unit which drives displacement means of the machine and a system for spreading a layer of concrete on the bottom and on the edges of the ditch as the machine advances.

In the field of public works, drainage ditches have to be dug, particularly on either side of roads and freeways. Some of these ditches are then concreted in order to facilitate the flow of water and to prevent them from being furrowed by rainwater and invaded by vegetation.

Machines of the above-mentioned type have been designed for automatically concreting such ditches. These self-propelled machines straddle the ditch and have displacement means, such as wheels or caterpillar bands, which bear and roll on either side of the ditch. In addition to the ditch to be dug, it is thus necessary to clear its surrounding edges in order to lay out thereon the rolling tracks which must be leveled substantially parallel to the bottom of the ditch. The importance of these laying-out works varies according to the nature and the slope of the terrain. Generally, these machines operate very well on terrain which is flat or which has a gentle slope and which is sufficiently clear, but their use is rendered virtually impossible in terrain with a considerable slope and to which access is difficult. Moreover, these machines have above all been designed for performing major works, in particular for the concreting of wide and deep ditches.

The aim of the invention lies in the provision of a self-propelled machine which is particularly suited to the concreting of small narrow ditches and which may be used in undulating terrains where access may be difficult.

SUMMARY OF THE INVENTION

To this end, the invention proposes a machine for the concreting of ditches, which is characterized in that its displacement means bear and roll on the bottom of the ditch.

According to a preferred embodiment, the displacement means of the machine consist of at least one caterpillar band which advances on the bottom of the ditch.

According to a further arrangement of the invention, the spreading system, located towards the rear of the machine, is towed by the caterpillar band bearing, in particular, on the layer of concrete which has just been deposited at the rear of the machine.

The spreading system essentially comprises a hopper for storing the concrete, an endless screw in the bottom of the hopper for conveying the concrete into shuttering matching the form of the ditch, this shuttering comprising a lower opening opposite the bottom of the ditch and through which the concrete falls, due to gravity, in order to form the bottom concrete layer, this lower opening being extended by two side openings located opposite the edges of the ditch and through which the concrete is cast, by means of fins driven in rotation by the endless screw in order to form the side concrete layers.

The spreading system is completed by compression means, such as a plate with a trapezoidal cross-section which simultaneously compresses the layers of concrete deposited on the bottom and on the edges of the ditch, this plate also acting as a bearing surface for the spreading system during the advance of the machine.

According to an important advantage of the invention, since the machine bears only on the bottom of the ditch, it makes it possible to dispense with all the laying-out works for the surrounding edges of the ditch which were hitherto necessary for the displacement of machines of the prior art. It is thus possible to reduce the time and the costs of creating a concreted ditch.

According to a further advantage of the invention, the machine guided by the caterpillar band, can follow any line, in particular with a considerable slope and in undulating terrains.

According to yet a further advantage of the invention, the machine is compact and of small dimensions, which facilitates its transportation to the sites of use.

Further advantages, features and details of the invention will emerge from the explanatory description which will follow and which is made with reference to the appended drawings which are given solely by way of example, and in which:

BRIEF DESCRIPTION OF THE DRAWINGS

FIG. 1 is a diagrammatic perspective view of the machine according to the invention, FIG. 3 is a simplified view of the shuttering of the system for spreading the concrete.

DETAILED DESCRIPTION OF THE PREFERRED EMBODIMENT

In FIG. 1, the machine 1 according to the invention is shown in its working position inside a ditch F with a trapezoidal cross-section, having a bottom FF which is substantially flat and two sloping side edges BF. In this figure, the double arrow F1 indicates the portion of the ditch which has already been concreted at the rear of the machine 1, the double arrow F2 indicates the portion of the ditch which is currently being concreted by the machine 1, and the double arrow F3 indicates the portion of the ditch which is not yet concreted, at the front of the machine 1.

Figure 2:
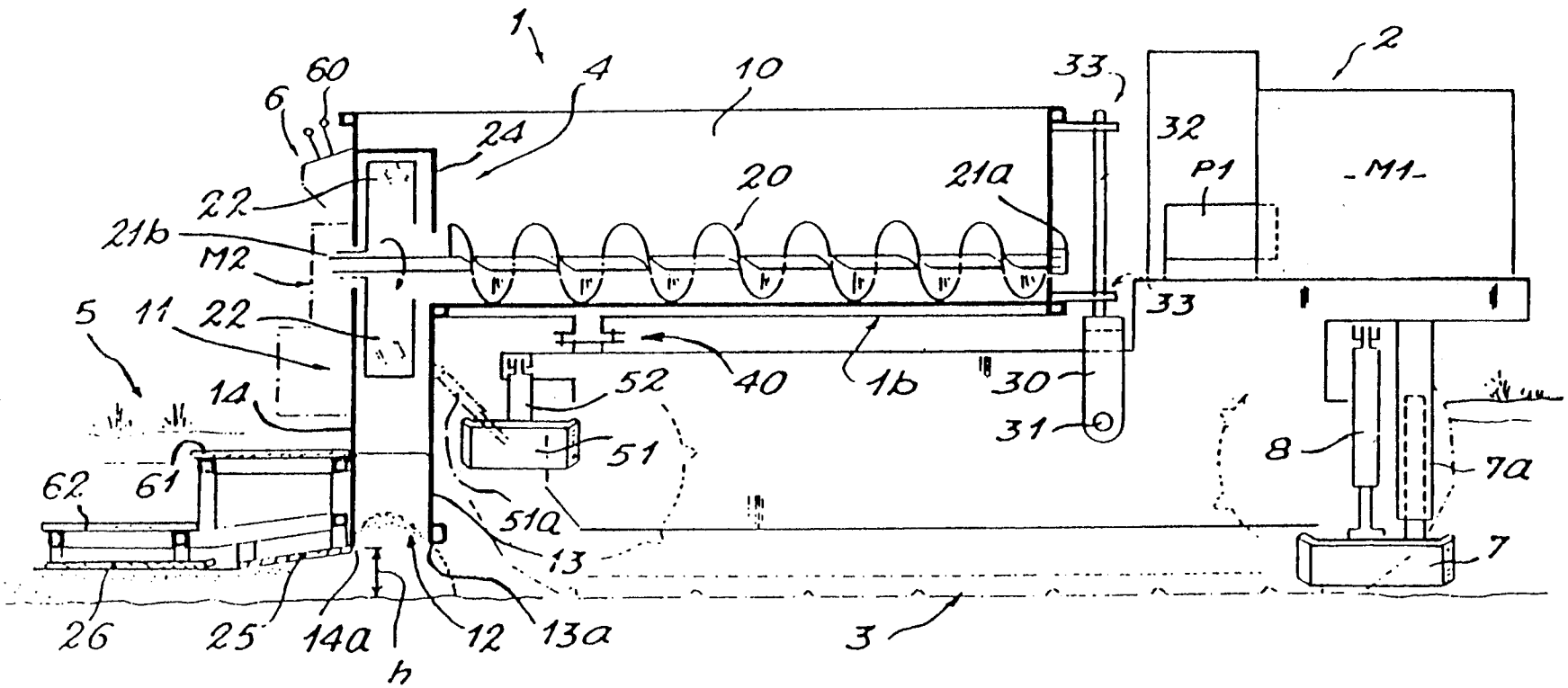
FIG. 2 is a simplified view in longitudinal section of the machine according to the invention.

Referring likewise to the general diagram in FIG. 2, the machine 1 comprises a propulsion unit 2 associated with displacement means 3, such as a caterpillar band, which bears and rolls on the bottom FF of the ditch F, a system 4 for spreading the concrete, a system 5 for compressing and smoothing the layers of concrete deposited in the bottom and on the edges of the ditch F, and a steering and control station 6.

These various component parts of the machine 1 will now be described in detail and the prepositions "in front" and "in back" used in the description should be considered relative to the direction of advance of the machine 1 inside the ditch F.

The propulsion unit 2 comprises a motor M1 mounted on a frame 1*a* supported by the caterpillar band 3 towards the front of the latter. This motor M1 drives the caterpillar band 3 by means of a geared motor and a transmission which are known per se and not shown. The propulsion unit likewise comprises a hydraulic pump P1 actuated by the motor M1 and whose role will be explained hereinbelow. Other parts, such as the tank of fluid necessary for the operation of the pump and the batteries have deliberately been omitted in the interests of clarification, together with the connecting circuits which are known per se.

Two shoes 7 are located on either side of the caterpillar band 3 towards the front of the latter. Each shoe 7 is articulated at the end of a stub axle 7*a*, the other end of which is fixed to the frame 1*a*. Each shoe 7 is controlled by means of a jack 8 mounted in a tilted position so that its piston rod can bring the shoe 7 to bear on the adjacent edge BF of the ditch F. These retractable shoes 7, controlled separately from the steering station 6, each act in order to modify the direction of advance of the caterpillar band 3. The jacks 8 are fed from the pump P1.

The spreading system 4 comprises a hopper 10 for storing the concrete, which hopper is placed above the caterpillar band 3 in back of the propulsion unit 2. The hopper 10 ends, at its rear end, beyond the rear end of the caterpillar band 3, in shuttering 11 with a trapezoidal transverse section, which extends, on the one hand, laterally on either side of the hopper 10 in the direction of the edges BF of the ditch F and, on the other hand, vertically in the direction of the bottom FF of the ditch F.

With reference to FIGS. 1 and 3, the shuttering 11 has a central lower opening 12 located opposite the bottom FF of the ditch F. This opening 12 is delimited by the horizontal lower edges 13*a*, 14*a* of two vertical front 13 and rear 14 walls which are parallel, spaced and extend perpendicularly to the longitudinal axis of the machine 1. These lower edges 13*a*, 14*a* extend over a length corresponding substantially to the width of the bottom FF of the ditch F and are located at a height h of the latter. The shuttering 11 likewise has two side openings 15 which laterally extend the central opening 12. Each side opening 15 extends widthways between the two front 13 and rear 14 walls and, in terms of height, over a length corresponding substantially to the height of the adjacent side edge BF of the ditch to be concreted. Each side opening 15 is located in a plane which is substantially parallel to the adjacent edge BF of the ditch and at a distance from the latter which is defined by the sloping edges 13*b*, 14*b* of the two front 13 and rear 14 plates which are separated by a distance d from the edge BF of the ditch F. Each side opening 15 is associated with a flap 15*a* mounted slideably in the plane of the opening 15 in order to modify its passage cross-section according to the height of the concreting of the adjacent edge BF of the ditch F, as shown diagrammatically in FIG. 3.

The concrete which is poured into and stored in the hopper 10 is conveyed into the shuttering 11 by means of an endless screw 20 located in the bottom of the hopper 10 and extending along the axis of the machine 1. This endless screw 20 is supported in rotation at its two ends by two bearings 21*a*, 21*b* fixed to the two transverse end walls of the hopper 10. At its rear end, the endless screw 20 passes through the rear end wall 14 of the shuttering 11 in order to be driven in rotation by an auxiliary hydraulic motor M2 fed from the pump P1. At the level of the shuttering 11, the endless screw 20 supports two fins 22 in rotation, which fins mix the concrete in order to cast it laterally onto the edges BF of the ditch F via the side openings 15. Since the shuttering 11 is open at its top part corresponding to the rear part of the hopper 10, a deflector 24 is provided in order to prevent the concrete mixed by the fins 22 from being ejected outside the shuttering 11 (FIG. 1).

Figure 4:
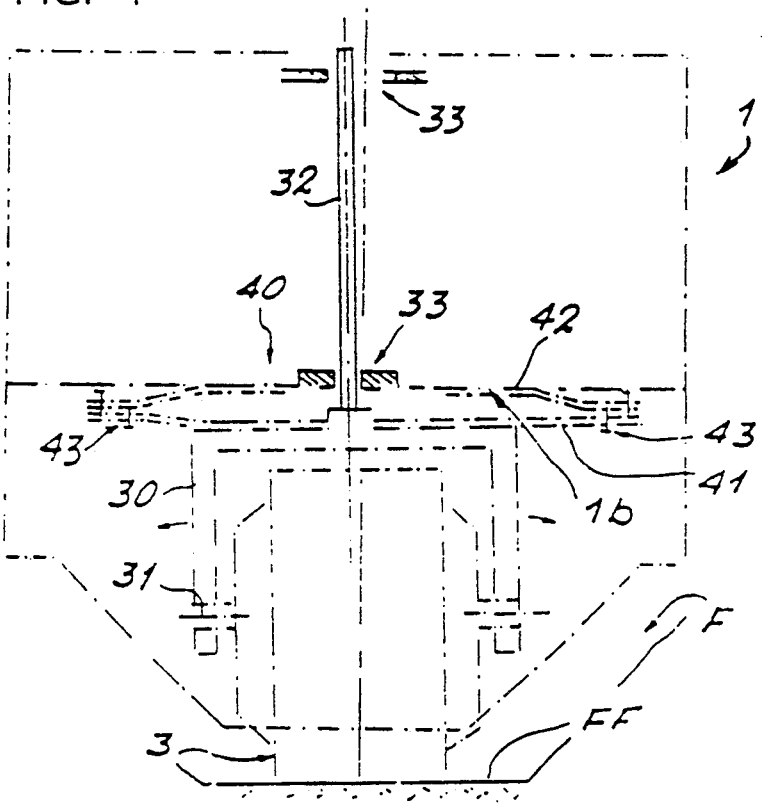
FIG. 4 is a basic diagrammatic view of the adjustment of the thickness of the layer of concrete deposited.
Figure 5:
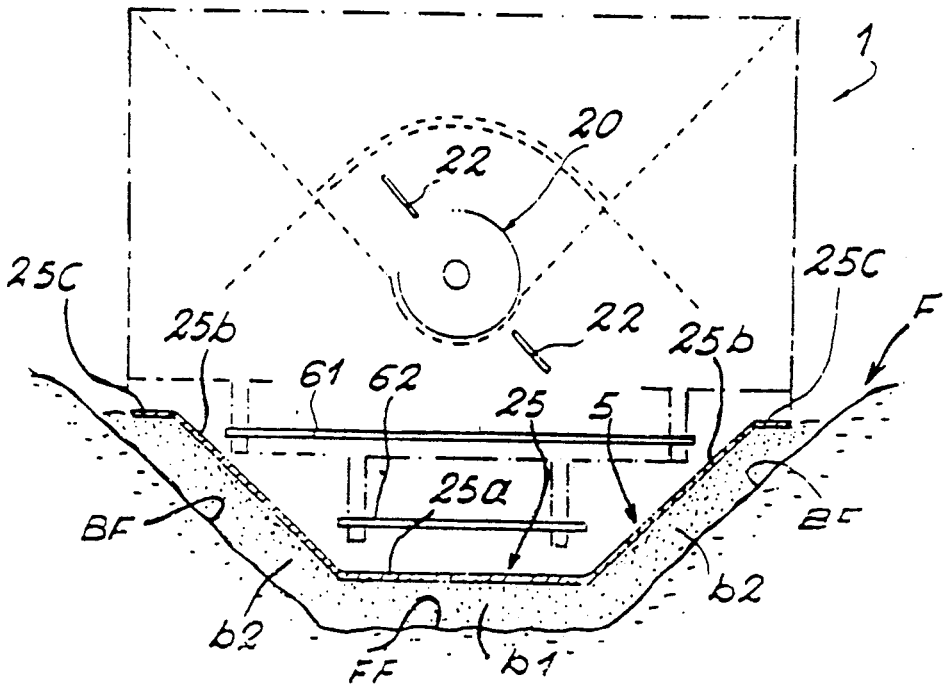
FIG. 5 is a simplified view of the rear of the machine in order to show the means for compressing the layers of concrete deposited in the ditch.

The compression and smoothing system 5, FIGS. 1 and 5, is formed by a plate 25 with a trapezoidal cross-section slightly tilted from the front towards the rear. This plate 25 is fixed, via one end or front end, to the base of the rear wall 14 of the shuttering 11. The distance separating the rear edge of this plate 25 from the ditch F determines the thicknesses of the layers of concrete on the bottom FF and on the side edges BF of the ditch F. The plate 25 comprises a central part 25 a opposite the bottom FF of the ditch and two sloping side portions 25*b* which are parallel to the edges BF of the ditch F. The sloping portions 25*b* end in a flange 25*c* in the direction of an adjacent edge BF of the ditch. This plate 25 is extended by a plate 26 for smoothing the layers of concrete and which has the same trapezoidal cross-section as the compressing plate 25. The spreading system 4 described above rests on a frame 1*b* which is substantially horizontal and supported by the caterpillar band 3. This frame 1*b*, FIG. 4, supports a cradle 30 mounted so as to pivot about a horizontal axis 31 perpendicular to the longitudinal axis of the machine 1. This cradle 30 is extended by a vertical rod 32 on which is fixed, by attachment means indicated at 33, the front end surface of the hopper 10 in order for the caterpillar band 3 to tow the spreading system.

The structure of the machine 1 is completed by devices for adjusting, on the one hand, the thickness of the layers of concrete and, on the other hand, for the stability of the spreading system.

Referring to FIGS. 2 and 4, the device 40 for adjusting the thickness of the layers of concrete consists, in the example under consideration here, of two blades 41, 42 which are opposite one another and supported by the frame 1*b* and the base of the hopper 10, respectively. These blades extend perpendicularly to the longitudinal axis of the machine 1 and are located towards the rear portion of the caterpillar band 3. Screws 43, located towards the two ends of these blades 41, 42, pass through one blade in order to bear on the other blade in order to separate them from one another, involving a pivoting movement of the spreading system 4 towards the front about the axis of rotation 31 located at the front of the caterpillar band 3. When the blades 41, 42 bear on one another, the height h defining the thickness of the layer deposited on the bottom FF of the ditch F and the distance d defining the thickness of the layers of concrete on the edges BF of the ditch F are minimal. Any gap between the blades 41, 42 thus involves an increase in the height h and in the distance d. Generally, this adjustment device acts only over a few centimeters.

Referring again to FIG. 1, the device for adjusting the stability of the spreading system 4 comprises two retractable side shoes 51 disposed on either side of the caterpillar band 3 towards the rear of the latter. Each shoe 51 is articulated at the end of a stub axle 51*a* whose other end is articulated on the frame 1*b* and is controlled in displacement by means of a jack 52 mounted in a tilted position so as to temporarily press the associated shoe 51 against the adjacent edge BF of the ditch F. The jacks 52 are controlled separately from the steering station 6 and fed from the pump P1.

When one of the shoes 51 bears on the adjacent edge BF of the ditch F, the entire spreading system 4 can pivot about the longitudinal axis of the machine 1 by virtue of the play which is provided at the level of its anchorage to the rod 32 integral with the frame 1*b* carried by the caterpillar band 3 (FIG. 4).

Referring to FIGS. 1 and 5, the steering station 6 comprises a set of levers 60 (FIG. 1), particularly those for controlling the motors M1 for driving the caterpillar band 3 and M2 for rotating the endless screw 20, the jacks 8 for displacing the steering shoes 7 and the jacks 52 for displacing the stability shoes 51. The person responsible for actuating these various controls stands on a horizontal platform 61 fixed on top of the compressing plate 25, for example (FIG. 5). An auxiliary horizontal platform 62, below the platform 61, is fixed on top of the smoothing plate 26 in order to enable a second person to monitor the operations and to correct, when necessary, with a handtool, the imperfections in the smoothing of the layers of concrete.

The operation of the machine 1 described above follows easily from the structure of this machine. The machine 1 is displaced by its caterpillar band 3 on the bottom FF of the ditch F. The concrete, which has previously been poured into and stored in the hopper 10, is driven by the endless screw 20 inside the shuttering 11. The concrete falls directly, due to gravity, through the lower central opening 12 onto the bottom FF of the ditch F. The fins 22, driven in rotation by the endless screw 20, mix the concrete and eject it via the side openings 15 onto the edges BF of the ditch F. The concrete thus deposited in a coarse thickness at the exit of the shuttering 11 is brought to a thickness close to h in the bottom FF of the ditch F and to a thickness close to d on the edges BF as the machine 1 advances by means of the rear wall 14 of the shuttering 11. In fact, this wall 14 forms a stop which limits the deposition of the concrete in the space located between the ditch F and the compressing plate 25. After the passage of this slightly tilted plate 25, the thicknesses of the layers b1, b2 (FIG. 5) correspond to the values defined by h and d, these being generally substantially equal.

When the ditch F curves, the steering shoe 7, located outside the radius of curvature, is controlled in displacement in order to bear on the adjacent edge BF in order to thereby modify the direction of the caterpillar band 3. The time during which the shoe 7 bears on the edge BF of the ditch depends on the radius of curvature of the ditch F and on the speed of advance of the machine 1. In parallel, the stability shoes 51 optionally bear on the adjacent edges BF of the ditch F according to the profile of the bottom FF of the ditch F in order to keep the spreading system substantially in the axis of the ditch F and so as to obtain substantially constant thicknesses of layers of concrete.

The machine as described may obviously be used for concreting irrigation channels, that is to say that its field of application is not restricted only to ditches at the sides of roads or freeways.

Obviously, the component parts of the machine described by way of example may be replaced by equivalent means within the scope of a person skilled in the art. In particular, the displacement system 3 may consist of two articulated and steering caterpillar bands mounted one behind the other, which makes it possible to dispense with the steering shoes 7. The spreading system may be supplemented by two complementary endless screws mounted inside the shuttering 11 and which make it possible to lift the concrete so that the latter is deposited in sufficient quantity on the edges BF of the ditch F, particularly when these edges must be concreted over a considerable height. The screws 43 which serve to adjust the thickness of the layers of concrete may be replaced by hydraulic jacks. A metal grid forming a reinforcement may be unrolled beforehand on the bottom and on the edges of the ditch F and then embedded in the layers of concrete deposited by the machine in order to produce ditches made from reinforced concrete. Finally, such a machine may likewise be remotely controlled or remotely guided, according to known techniques already used for public works machinery.

We claim:

1. A self-propelled machine for the concreting of a ditch having a substantially plane horizontal bottom and two sloping sides, said machine having a front part and a rear part and comprising a displacement means located in said front part of the machine for bearing and rolling only on said bottom of said ditch, a propulsion unit which drives said displacement means, and a spreading system for continuously casting a layer of concrete onto said bottom and said sloping sides of said ditch, said spreading system being located in the rear part of the machine.

2. A self-propelled machine according to claim 1, wherein said displacement means consist of at least one caterpillar band.

3. A self-propelled machine according to claim 2, including two retractable steering shoes located in a lower part of said front part and on either side of said displacement means, said steering shoes being controlled by two jacks so that each selectively and temporarily bears on an adjacent sloping side of the ditch in order to modify the direction of the displacement means.

4. A self-propelled machine according to claim 1, wherein said spreading system comprises a hopper for storing concrete, a means for conveying concrete from the hopper into a shuttering having a central lower opening opposite a bottom of the ditch (F) and two side openings (15) opposite the sloping sides of the ditch and which laterally extend to said lower opening.

5. A self-propelled machine according to claim 4, wherein said shuttering is located towards the rear of the machine and beyond the displacement means.

6. A self-propelled machine according to claim 4, wherein said means for conveying concrete into the shuttering is an endless screw.

7. A self-propelled machine according to claim 6, including means for casting concrete sideways comprising fins housed inside said shuttering and mounted so as to rotate one said endless screw in order to cast concrete onto the sides of the ditch through the side openings in the shuttering, the concrete likewise falling, due to gravity, onto the bottom of the ditch through the lwer central opening in the shuttering.

8. A self-propelled machine according to claim 7, wherein said shuttering emerges, at a top part, in back of the hopper, and wherein a deflector is placed above the shuttering in order to prevent concrete from being cast outside the shuttering by rotation of the fins.

9. A self-propelled machine according to claim 4, wherein said spreading system comprises a tilted plate for compressing layers of concrete deposited on a bottom and sides of the ditch (F), said late being located at the base and in back of the shuttering and shaped like the form of the ditch.

10. A self-propelled machine according to claim 9, wherein said compressing plate is separated from the bottom and sides of the ditch by a distance controlled by separation means, and determining the thickness of layers of concrete deposited on he bottom and sides of the ditch, respectively.

11. A self-propelled machine according to claim 9, wherein a plate for smoothing the concrete is towed by the compressing plate.

12. A self-propelled machine according to claim 1, including a device ensuring the horizontal and transverse stability of the spreading system as the machine advances, said device comprising two retractable shoes located on either side and in a top part of the spreading system and controlled by two jacks so that each selectively and temporarily bears on an adjacent sloping side of the ditch.

* * * * *